US005863352A

United States Patent [19]

Gonda

[11] Patent Number: 5,863,352

[45] Date of Patent: Jan. 26, 1999

[54] METHOD FOR CLEANING PAINTING APPARATUS

[75] Inventor: Shigeyuki Gonda, Mie-ken, Japan

[73] Assignee: Isono International, Japan

[21] Appl. No.: 825,174

[22] Filed: Mar. 31, 1997

[30] Foreign Application Priority Data

May 30, 1996 [JP] Japan ..... 8-136344

[51] Int. Cl.[6] ..... B05B 12/14

[52] U.S. Cl. ..... 134/38; 134/18; 134/26; 134/30; 134/22.11; 134/22.12; 134/22.14; 134/22.18; 134/22.19

[58] Field of Search ..... 134/18, 26, 30, 134/38, 22.11, 22.12, 22.14, 22.18, 22.19

[56] References Cited

U.S. PATENT DOCUMENTS

| | | | |
|---|---|---|---|
| 3,870,233 | 3/1975 | Wilhelm et al. | 239/15 |
| 4,728,034 | 3/1988 | Matsumura et al. | 239/112 |
| 4,838,311 | 6/1989 | Vetter | 137/624.2 |
| 4,915,599 | 4/1990 | Katsuyama et al. | 417/393 |
| 4,993,353 | 2/1991 | Ogasawara et al. | 118/302 |
| 5,045,224 | 9/1991 | Watanabe et al. | 252/162 |
| 5,074,237 | 12/1991 | Ogasawara | 118/302 |
| 5,152,466 | 10/1992 | Matushita et al. | 239/690 |
| 5,221,042 | 6/1993 | Akeel | 239/123 |

*Primary Examiner*—Jill Warden
*Assistant Examiner*—Sharidan Carrillo
*Attorney, Agent, or Firm*—Longacre & White

[57] ABSTRACT

In a method for cleaning a first paint remained in a painting apparatus with thinner when said first paint is changed to a second paint, the cleaning time of the first paint is varied in accordance with the difference between a predetermined property of the first paint and that of the second paint. First, a table of a plurality of cleaning patterns according to the predetermined property of paint to be utilized in the painting apparatus is prepared. Next, when the current paint is changed to next paint, the current paint and the next paint are classified into a plurality of classes by the predetermined property, and a cleaning pattern corresponding to the class of the current paint and the class of the next paint is selected from the table. Then, the current paint is cleaned with thinner according to the selected cleaning pattern.

1 Claim, 4 Drawing Sheets

Fig. 3

| Next \ Current | White | Hypochrome | Hyperchrome | White metallic | Hypochrome metallic | Hyperchrome metallic |
|---|---|---|---|---|---|---|
| White | Pattern 1 | Pattern 2 | Pattern 5 | Pattern 3 | Pattern 4 | Pattern 5 |
| Hypochrome | Pattern 2 | Pattern 1 | Pattern 5 | Pattern 4 | Pattern 3 | Pattern 5 |
| Hyperchrome | Pattern 5 | Pattern 5 | Pattern 1 | Pattern 5 | Pattern 5 | Pattern 3 |
| White metallic | Pattern 3 | Pattern 4 | Pattern 5 | Pattern 1 | Pattern 2 | Pattern 5 |
| Hypochrome metallic | Pattern 4 | Pattern 3 | Pattern 5 | Pattern 3 | Pattern 1 | Pattern 5 |
| Hyperchrome metallic | Pattern 5 | Pattern 5 | Pattern 3 | Pattern 5 | Pattern 5 | Pattern 1 |

Fig.4

| Cleaning pattern / Cleaning procedure | Pattern 1 (sec) | Pattern 2 (sec) | Pattern 3 (sec) | Pattern 4 (sec) | Pattern 5 (sec) |
|---|---|---|---|---|---|
| Paint removing gas ejection | 3.5 | 3.5 | 3.5 | 4.0 | 4.0 |
| First thinner cleaning | 3.0 | 2.5 | 2.5 | 3.0 | 3.0 |
| First thinner removing gas ejection | 3.5 | 3.5 | 3.5 | 4.0 | 4.0 |
| Second thinner cleaning | 0 | 2.5 | 2.5 | 3.0 | 3.0 |
| Second thiner removing gas ejection | 0 | 3.5 | 4.0 | 4.0 | 4.5 |
| Next-paint filling | 3.5 | 3.5 | 4.0 | 4.0 | 4.5 |
| TOTAL (sec) | 13.5 | 19.0 | 20.0 | 22.0 | 23.0 |

METHOD FOR CLEANING PAINTING APPARATUS

BACKGROUND OF THE INVENTION

1. Field of the Invention

The present invention relates to a method for cleaning a painting apparatus, which cleans paint remained in the painting apparatus, e.g., passages when the paint is changed to another color or to another type for next work, e.g., automobiles.

2. Description of Related Art

FIG. 1 is a schematic view showing a typical painting apparatus. In FIG. 1, reference numeral 1 is a color switching painting apparatus. The color switching painting apparatus 1 comprises a first manifold 2, paint reservoirs 3, 3' each containing paint having a different color, volumetric force feeding pumps 4, 4' for supplying the paint from the paint reservoirs 3, 3' to the manifold 2 through paint supply pipes 5, 5', solenoid valves 6, 6' placed on the paint supply pipes 5, 5', a thinner reservoir 7 containing thinner, a force feeding pump 8 for supplying thinner from the thinner reservoir 7 to the manifold 2 though a thinner supply pipe 9, a solenoid valve 10 placed on the thinner supply pipe 9, a gas supply 11 for supplying air, nitrogen and others, a gas supply pipe 12, a solenoid valve 13 placed on the gas supply pipe 12, a first painting robot 14 connected to the manifold 2 with a hose 15, second and third manifolds 2', 2" to which the same members as the first manifold 2 are connected, a second painting robot 14' connected to the manifold 2' with a hose 15', a third painting robot 14" connected to the manifold 2" with a hose 15", a robot control device 16 to which the first, second and third painting robots 14, 14', 14" are connected with control signal cables 17, and a color switching control device 18 to which the first, second and third manifolds 2, 2', 2" are connected with control signal cables 19. The control signal cables 19 are connected to the solenoid valves 6, 6', 10, 13, the volumetric force feeding pumps 4, 4', the force feeding pump 8 and others through the manifolds 2, 2', 2", which are not shown in detail in FIG. 1.

There is a painting chamber 20 in which a work W is painted in the color switching painting apparatus 1. In the painting chamber 20, the work to be painted W is mounted on a dolly 22 shown in FIG. 2 and transferred to the painting chamber 20 along a transferring line 21. Provided at the head 22*a* of the dolly 22 is a removable paint color indicating plate 23 having paint color indicating holes 24. There provided a light emitting device 25 and a light receiving device 26 opposed to each other at the entrance of the painting chamber 20 in the transferring line 21.

In order to change the paint color for the next work W, a light emitting unit 25 emits light and when a light receiving unit 26 receives the light coming through the paint color indicating holes 24, it generates a signal. The generated signal is applied to the robot control device 16 and the color switching control device 18, and then the robot control device 16 and the color switching control device 18 start cleaning the paint remained in the painting apparatus for the next work after the painting of the current work is finished.

The paint color indicating plate 23 has one or a plurality of the paint color indicating holes 24 corresponding to the paint colors. For example, forming two color indicating holes 24 shown in FIG. 2 is meant that the paint color is white. One light source for emitting thick beams can be used as the light emitting unit 25, and a plurality of the light receiving unit 26 are arranged corresponding to the plurality of the paint color indicating holes 24. In the case of FIG. 2, two light receiving units 26 receive the light emitting from the light emitting device 25 through the paint color indicating holes 24, so that the paint color can be distinguished as white. Therefore, the paint color indicating holes 24 indicate the paint color by the number of holes 24. Alternatively, the paint color indicating holes 24 can be arranged in one line so as to be binary digits (hole is 1: no hole is 0). In this case, if the used number of the paint color indicating holes 24 is zero to four for the four binary digits, sixteen colors can be distinguished. In the case of the five binary digits, zero to five paint color indicating holes 24 are used and thirty two color can be distinguished.

When the paint color is changed to another color in the painting apparatus, the paint remained in the passages of the painting apparatus has to be cleaned, e.g., with thinner. Conventionally, when the paint color is changed to another color, the same cleaning method is applied for all types of paint, which will be described next.

First, the solenoid valve 13 is opened for four seconds to pass air, nitrogen and others from the air supply 11 through the gas supply pipe 12. Accordingly, the paint remained in the manifold 2, the hose 15 from the manifold 2 to the painting robot 14, the painting robot 14 and others are blown away for four seconds, which is the paint removing gas ejection.

Next, the solenoid valve 10 is opened for three seconds to supply thinner of the thinner reservoir 7 to the manifold 2 through the thinner supply pipe 9 and the force feeding pump 8. Then, the paint remained in the manifold 2, the hose 15 from the manifold 2 to the painting robot 14, the painting robot 14 and others are cleaned by thinner for three seconds, which is the first thinner cleaning.

Thereafter, the solenoid valve 13 is opened for four seconds to supply air from the gas supply 11 to the manifold 2 through the gas supply pipe 12. The thinner remained in the manifold 2, the hose 15 from the manifold 2 to the painting robot 14, the painting robot 14 and others are blown away by gas for four seconds, which is the first thinner removing gas ejection.

Next, similar to the first thinner cleaning, the second thinner cleaning is operated that the paint remained in the manifold 2, the hose 15 from the manifold 2 to the painting robot 14, the painting robot 14 and others are cleaned by thinner for three seconds.

Thereafter, similar to the first thinner removing gas ejection, the second thinner removing gas ejection is operated that the paint remained in the manifold 2, the hose 15 from the manifold 2 to the painting robot 14, the painting robot 14 and others are blown away by gas for 4.5 seconds.

Next, the solenoid valve 6 (or 6') is opened for 4.5 seconds to supply the paint from the paint reservoir 3 (or 3') to the manifold 2 through the volumetric force feeding pumps 4 (or 4') and the paint supply pipe 5 (or 5'). Then, the paint to be used next is filled in the manifold 2, the hose 5 from the manifold 2 to the painting robot 14, the painting robot 14 and others, which is the next-paint filling and which completes the paint color switching.

The total cleaning time in this case is 23 seconds. After the paint color switching is completed, the painting robot 14 is operated by the robot control device 16 to paint the work W.

In the conventional cleaning method, although there are many types of paint, the same cleaning method is applied for all types of paint, which may make the cleaning operation longer and which may increase the manufacturing cost.

BRIEF SUMMARY OF THE INVENTION

It is an object of the present invention to provide a method for cleaning a painting apparatus, which makes the cleaning time short and which reduces the manufacturing cost.

In order to accomplish the above object, a method for cleaning a painting apparatus of the present invention which is a method for cleaning a first paint remained in a painting apparatus with thinner when the first paint is changed to a second paint, comprises varying cleaning time of the first paint in accordance with the difference between a predetermined property of the first paint and the predetermined property of the second paint.

Here, as the difference between the predetermined property of the first paint and the predetermined property of the second paint becomes small, the cleaning time is made shorter.

A method for cleaning a first paint of the present invention further comprises classifying the first paint and the second paint into a plurality of classes by a predetermined property, comparing the class of the first paint with the class of the second paint, in a case that the class of the first paint is different from the class of the second paint, making cleaning time of the first paint longer as the difference between the class of the first paint and the class of the second paint becomes large, and in a case that the class of the first paint is the same as the class of the second paint, making the cleaning time shorter than the cleaning time in the case of the class of the first paint different from the class of the second paint.

Furthermore, according to the another aspect of the present invention, a method for cleaning a first paint remained in a painting apparatus using a thinner when the first paint is changed to a second paint, the method for cleaning the first paint comprises preparing a table of a plurality of cleaning patterns according to a predetermined property of paint to be utilized in the painting apparatus, when the first paint is changed to the second paint, classifying the first paint and the second paint into a plurality of classes by the predetermined property, selecting a cleaning pattern corresponding to the class of the first paint and the class of the second paint from the table, and cleaning the first paint using the thinner in accordance with the selected cleaning pattern.

Here, the cleaning patterns are made by in a case that the class of the first paint is different from the class of the second paint, making cleaning time of the first paint longer as the difference between the class of the first paint and the class of the second paint becomes large, and in a case that the class of the first paint is the same as the class of the second paint, making the cleaning time shorter than the cleaning time in the case of the class of the first paint different from the class of the second paint.

In the above-described present invention, the predetermined property is at least one of brightness, hue, color and a type of the paint.

According to the method for cleaning the paint apparatus of the present invention, the cleaning time of the paint currently used is varied with the properties of the paint currently used and the paint to be used next, so that the paint cleaning is efficiently operated and the cleaning time can be short. Further, the use of thinner may be decreased. Therefore, the manufacturing cost can be decreased.

BRIEF DESCRIPTION OF THE DRAWINGS

FIG. 3 is a table of cleaning patterns corresponding to properties of paint.

FIG. 4 is a table of cleaning procedures corresponding to the cleaning patterns.

PREFERRED EMBODIMENTS OF THE INVENTION

Figure 1:
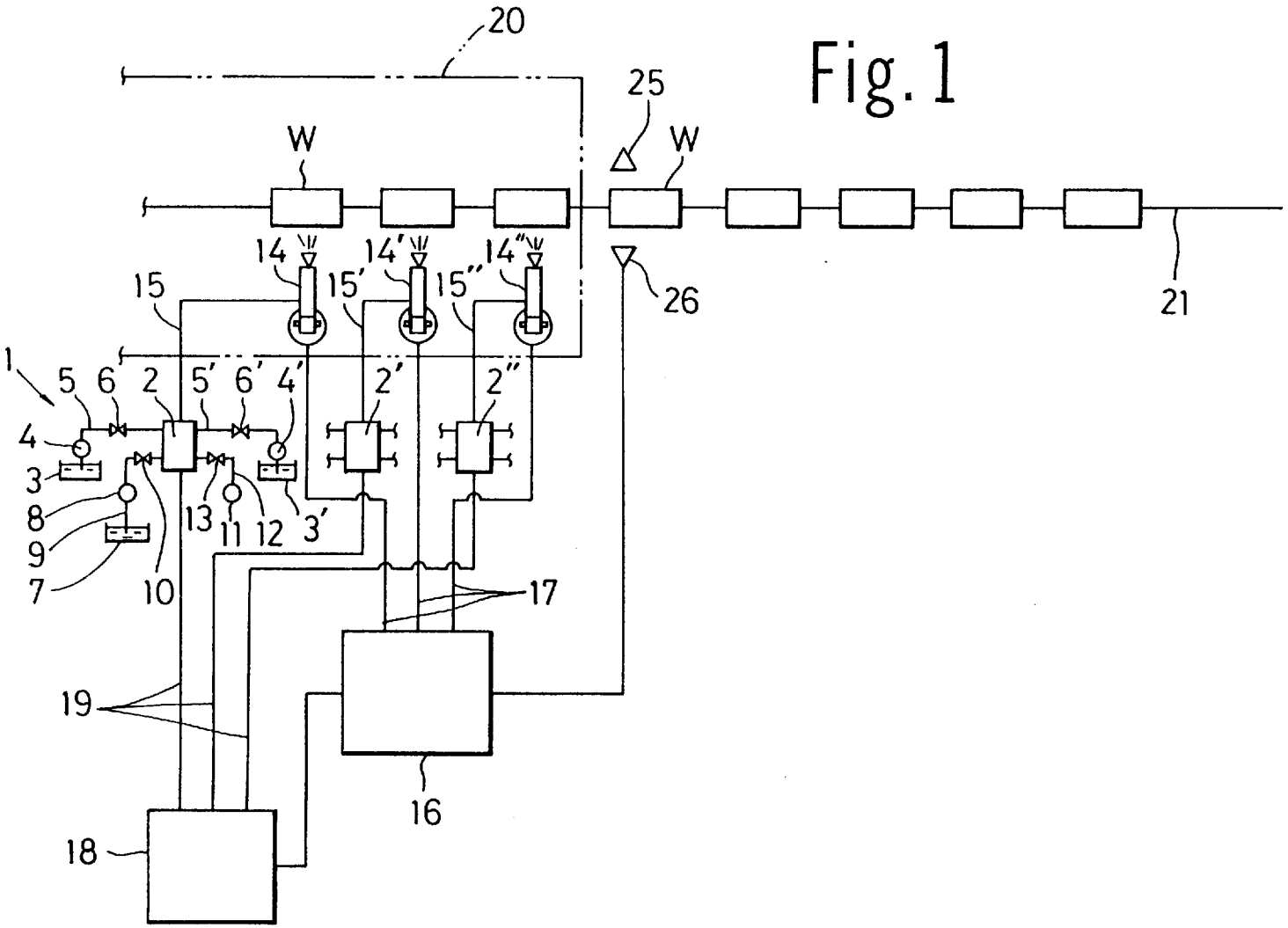
FIG. 1 is a schematic view showing the configuration of a typical painting apparatus.

The preferred embodiments of the present invention will be described hereinafter with reference to the accompanying drawings. In the following description and the drawings, the same reference numerals are used for the same components and repetitive description on the same components is omitted.

The basic configuration of a painting apparatus of the present invention is basically the same as the one described above with FIG. 1 and FIG. 2. Therefore, the description of the configuration of the painting apparatus will be omitted.

A method for cleaning a painting apparatus of the preferred embodiment of the present invention comprises one or more steps selected from the paint removing gas ejection for blowing away the paint remained in the painting apparatus by gas, the first thinner cleaning for cleaning the paint remained in the painting apparatus with thinner, the first thinner removing gas ejection for blowing away the thinner remained from the first thinner cleaning in the painting apparatus by gas, the second thinner cleaning for cleaning the paint remained in the painting apparatus with thinner, the second thinner removing gas ejection for blowing away the thinner remained from the second thinner removing gas ejection in the painting apparatus, and the next-paint filling for filling the paint to be used next into the manifold.

It should be noted that for each step, conventional procedures, e.g., the above-described procedure can be utilized.

In the method for cleaning the painting apparatus of the embodiment of the present invention, first, paint to be used in the painting apparatus is classified by properties of paint. For example, as shown in FIG. 3, the paint is classified into six classes: white, hypochrome, hyperchrome, white metallic, hypochrome metallic, and hyperchrome metallic.

The cleaning pattern is set for each combination of the paint currently used and the paint to be used next. In FIG. 3, five cleaning patterns are assigned. FIG. 4 shows the procedure of each cleaning pattern. For example, the pattern 1 is assigned in the case that the paint currently used is white and the paint to be used next is white, and the procedure of the pattern 1 includes 3.5 seconds of paint removing gas ejection, 3.0 seconds of the first thinner cleaning, 3.5 second of the first thinner removing gas ejection, and 3.5 seconds of the next-paint filling. The pattern 1 is the shortest cleaning pattern in the five patterns.

As apparent from FIG. 3, the shortest cleaning pattern 1 is assigned to the case that the paint currently used and the paint to be used next are both in the same class which means that the difference between the properties of the paint currently used and the paint to be used next is small or the same. Since the class of the paint currently used is the same as that of the paint to be used next, the second thinner cleaning and the second thinner removing gas ejection can be omitted.

On the other hand, when the paint currently used and the paint to be used next are in the different class, one of the cleaning patterns 2 to 5 is assigned. The procedure of the cleaning patterns 2 to 5 includes all steps: the paint removing gas ejection, the first thinner cleaning, the first thinner removing gas ejection, the second thinner cleaning, the second thinner removing gas ejection, and the next-paint filling; however, the duration of each step is set different for the cleaning patterns 2 to 5. The duration of each step is set longer as the difference between the properties of the paint currently used and those of the paint to be used becomes large.

For example, the pattern 5 that performs the longest cleaning procedure is assigned to the case the difference of the properties is large, e.g., white and hyperchrome, hyperchrome metallic and hypochrome metallic. The duration of the longest cleaning procedure of the cleaning pattern is 23.0 seconds.

According to the conventional cleaning method, the same procedure is applied to all types of paint without considering the properties of paint to be used next and paint currently used. Accordingly, the cleaning time is the same for all types of paint. According to the present invention, the procedure is set for each type of paint by considering the properties of the paint to be used and the paint currently used. Therefore, unnecessary steps are omitted or operated short, so that the paint cleaning can be operated efficiently and the use of thinner can be decreased.

Figure 2:
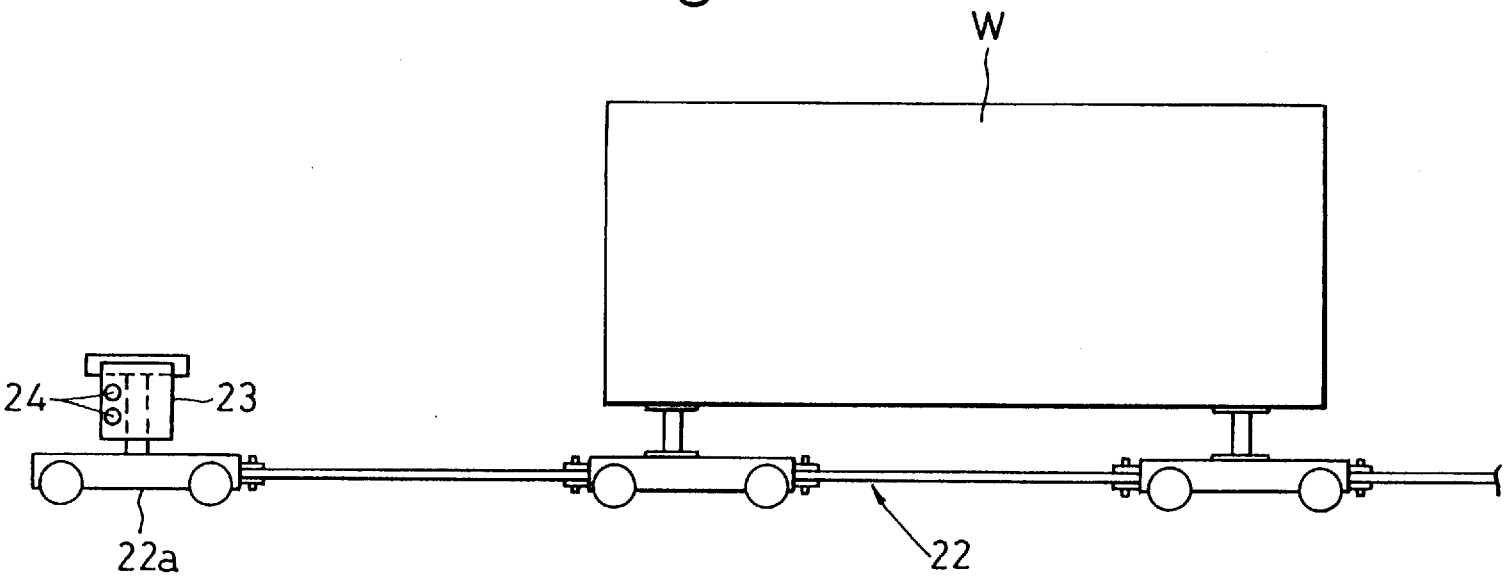
FIG. 2 is a schematic view showing a dolly mounting a work to be processed in the typical painting apparatus.

In order to perform the above-described procedures with the painting apparatus shown in FIGS. 1 and 2, the table of the cleaning patterns shown in FIG. 3 is stored in the memory of the color switching control device 18 and the corresponding cleaning procedure is also stored therein. The paint color is detected from the paint color indicating plate 23, and the cleaning pattern is selected from the table stored in the memory. Then, the color switching control device 18 controls to perform the corresponding cleaning procedure according to the one stored in the memory.

Alternatively, instead of using the paint color indicating plate, push buttons can be provided on the painting apparatus so that the classes of the paint currently used and the paint to be used next are selected by pushing the push buttons.

The class of the paint is not limited to the one shown in FIG. 3. For example, the number of the classes can be made large on the basis of the color data expressed in figures, e.g., difference of hue and chroma and the data of components of the paint. In this case, the number of cleaning patterns is increased corresponding to the class and the cleaning time of the painting apparatus is set for each cleaning pattern.

Thus, as described above, according to a method for cleaning a painting apparatus, when the paint color is changed, as the difference between the color system of the paint currently used and the paint to be used next becomes large, the duration of cleaning time is made longer. Accordingly, the duration of the paint color switching operation is made short and the use of thinner is decreased, so that the manufacturing cost can be decreased.

Further, the paint to be used is classified into some classes, and the table of cleaning patterns corresponding to the paint currently used and the paint to be used next is predetermined, so that the efficient cleaning pattern is easily selected from the table.

While the invention has been shown and described with reference to the illustrated embodiments, it should be understood that various changes in form and details may be made without departing from the scope of the invention which is defined in the appended claims.

What is claimed is:

1. A method for cleaning a first paint remaining in a painting apparatus with thinner when said first paint is changed to a second paint, said method for cleaning said first paint comprising the steps of:

a) classifying said first paint and said second paint each into one of a plurality of classes according to a predetermined property, wherein said predetermined property is defined by at least one of brightness, hue, color, and type of paint;

b) comparing a first class of said first paint with a second class of said second paint to determine a difference between a predetermined property of said first class of said first paint and a predetermined property of said second class of said second paint;

c) determining a period of time for cleaning of said first paint remaining in said painting apparatus based on said difference between said predetermined properties of said first class of said first paint and said second class of said second paint, and d) cleaning said first paint remaining in said painting apparatus based on said period of time, such that in a case that said predetermined property of said first class of said first paint is the same as said predetermined property of said second class of said second paint, reducing the period of time of cleaning said first paint from said painting apparatus, and in a case that said predetermined property of said first class of said first paint is different from said predetermined property of said second class of said second paint, increasing the period of time of cleaning said first paint from said painting apparatus.

* * * * *

UNITED STATES PATENT AND TRADEMARK OFFICE

CERTIFICATE OF CORRECTION

PATENT NO. : 5,863,352
DATED : January 26, 1999
INVENTOR(S) : Gonda, Shigeyuki

It is certified that error appears in the above-identified patent and that said Letters Patent is hereby corrected as shown below:

Title page,
Item [73], please change the assignee from "Isono International, Tokyo , Japan" to -- Honda Giken Kogyo Kabushiki Kaisha, Tokyo, Japan --

Signed and Sealed this

Third Day of June, 2003

JAMES E. ROGAN
*Director of the United States Patent and Trademark Office*